US008641558B2

(12) United States Patent
Ohira

(10) Patent No.: US 8,641,558 B2
(45) **Date of Patent: *Feb. 4, 2014**

(54) GOLF BALL

(75) Inventor: Takashi Ohira, Saitama-ken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 597 days.

This patent is subject to a terminal disclaimer.

(21) Appl. No.: 12/857,625

(22) Filed: Aug. 17, 2010

(65) Prior Publication Data

US 2010/0311521 A1 Dec. 9, 2010

Related U.S. Application Data

(63) Continuation of application No. 11/926,150, filed on Oct. 29, 2007, now Pat. No. 7,806,784.

(51) Int. Cl.
*A63B 37/12* (2006.01)

(52) U.S. Cl.
USPC ..... 473/378

(58) Field of Classification Search
USPC ..... 473/351, 378
See application file for complete search history.

(56) References Cited

U.S. PATENT DOCUMENTS

| | | | | |
|---|---|---|---|---|
| 5,713,802 | A | 2/1998 | Moriyama et al. | |
| 6,824,479 | B2 | 11/2004 | Isogawa et al. | |
| 7,278,931 | B2 | 10/2007 | Manami et al. | |
| 7,291,076 | B2 | 11/2007 | Watanabe | |
| 7,806,784 | B2 * | 10/2010 | Ohira | 473/378 |
| 2006/0287133 | A1 | 12/2006 | Okabe et al. | |

FOREIGN PATENT DOCUMENTS

| | | | |
|---|---|---|---|
| JP | 06-170013 | A | 6/1994 |
| JP | 06-339973 | A | 12/1994 |
| JP | 2001-3001 | A | 1/2001 |
| JP | 2003-286438 | A | 10/2003 |
| JP | 2004-81350 | A | 3/2004 |
| JP | 2004-166719 | A | 6/2004 |
| JP | 2007-214 | A | 1/2007 |
| JP | 2007-21205 | A | 2/2007 |
| JP | 2007-70424 | A | 3/2007 |
| JP | 2007-190385 | A | 8/2007 |

* cited by examiner

*Primary Examiner* — Raeann Gorden
(74) *Attorney, Agent, or Firm* — Sughrue Mion, PLLC

(57) ABSTRACT

The present invention relates to a golf ball having a solid core of at least one layer, a cover of at least one layer encasing the core, and a paint film on a surface of the cover, wherein at least one cover layer and/or the paint film includes a luster pigment composed of metal oxide-coated alumina flakes. This golf ball has a high commercial value because of its visual impact and high quality feel, and because it achieves a bright, color-saturated effect without the yellow cast typical of conventional golf ball surfaces.

15 Claims, No Drawings

GOLF BALL

This is a Continuation of U.S. patent application Ser. No. 11/926,150 filed Oct. 29, 2007. The entire disclosure of the prior application is considered part of the disclosure of the accompanying continuation application, and is hereby incorporated by reference.

BACKGROUND OF THE INVENTION

The present invention relates primarily to a golf ball of improved appearance, which ball achieves a bright, color-saturated effect and has a high quality feel.

In the technical field relating to golf balls, various innovations are commonly made to improve ball performance, including distance, feel, controllability and durability. Over the past few years, in addition to such ball performance characteristics, there has been a growing demand for visual impact, attractiveness, and a high quality feel. It has thus become important recently to finish the golf ball so as to make the appearance at the ball's surface more attractive and impart a high quality feel, and also to maintain this appearance to some degree even after the ball has been played.

An example of such a golf ball is described in, for example, JP-A 6-170013. This golf ball contains, in a paint layer or in the ball itself, a pearlescent colored pigment which is composed of a mica core coated with titanium oxide.

While this prior-art golf ball does have a visual impact, there is room for improvement because it has a yellow cast due to trace impurities present in the mica, which does not feel quite right in a golf ball presumed to be white.

Another prior-art golf ball, disclosed in JP-A 2004-81350, is a painted golf ball which, through the use of a color-shifting material in the paint, has been conferred with fashionability and a high quality feel.

However, the paint film or cover material is colored in these golf balls is clearly intended to be colored. Unfortunately, the range of useful applications for colors in golf balls, which are generally white, is limited.

SUMMARY OF THE INVENTION

It is therefore an object of the present invention to provide a golf ball which achieves a bright, color-saturated effect and has a high quality feel.

As a result of extensive investigations to achieve the above object, the inventor has discovered that, in a golf ball having a solid core of at least one layer, a cover of at least one layer encasing the core, and a paint film on a surface of the cover, by including a luster pigment composed of metal oxide-coated alumina flakes in at least one layer of the cover and/or the paint film, the golf ball has a visual impact and is provided with a high quality feel, in addition to which the ball achieves a bright, color-saturated effect without exhibiting a yellow cast. In cases where the cover is made of two or more layers, the objects of the invention can be effectively achieved by including the luster pigment in the outer cover layer and/or the paint film.

Accordingly, the invention provides the following golf balls.

(1) A golf ball comprising a solid core of at least one layer, a cover of at least one layer encasing the core, and a paint layer on a surface of the cover, wherein at least one cover layer and/or the paint layer includes a luster pigment composed of metal oxide-coated alumina flakes.

(2) The golf ball of (1), wherein the cover is formed of two or more layers, one of which is an outer cover layer that includes therein the luster pigment.

(3) The golf ball of (1), wherein the metal oxide in the luster pigment is of at least one type selected from the group consisting of titanium oxide, iron oxide and zinc oxide.

(4) The golf ball of (1), wherein the luster pigment has a particle size distribution of from 1 to 50 μm.

(5) The golf ball of (1), wherein the paint layer on the surface of the cover is formed of a paint composed of a thermoset polyurethane.

(6) The golf ball of (1), wherein the paint layer is formed of a paint which includes the luster pigment and a luster pigment dispersion and anti-settling additive.

(7) The golf ball of (1), wherein the paint layer is formed of a paint which includes the luster pigment in an amount of from 1 to 15 parts by weight per 100 parts by weight of base resin (solids) in the paint.

(8) The golf ball of (6), wherein the luster pigment dispersion and anti-settling additive is at least one selected from the group consisting of organic bentonite, amide wax, oxidized amide wax, hydrogenated castor oil wax, metal soaps, oxidized polyethylene, polymerized vegetable oils, sulfate ester-type anionic activators, amine salts of polycarboxylic acids, ultrafine silica, magnesium aluminum silicate, xanthan gum and guar gum.

(9) The golf ball of (8), wherein the luster pigment dispersion and anti-settling additive is included in an amount of from 0.05 to 10 parts by weight per 100 parts by weight of paint which already includes a polyol component, an isocyanate component and necessary additives.

(10) The golf ball of (1), wherein the cover is formed of at least one selected from the group consisting of thermoplastic resins, thermoplastic elastomers, and thermoset resins.

(11) The golf ball of (10), wherein the cover includes the luster pigment in an amount of from 0.1 to 10 parts by weight per 100 parts by weight of the resin and/or elastomer making up the cover.

DETAILED DESCRIPTION OF THE INVENTION

The invention is described more fully below.

The golf ball of the invention, while not shown in an accompanying diagram, is composed of a solid core of at least one layer, a cover of at least one layer encasing the core, and at least one paint film on a surface of the cover.

The solid core may be formed using a known rubber material as the base material. A known base rubber such as natural rubber or a synthetic rubber may be employed for this purpose. More specifically, the use of polybutadiene, particularly cis-1,4-polybutadiene having a cis structure of at least 40%, is recommended. If desired, the base rubber may also be composed of, together with the foregoing polybutadiene, another rubber such as natural rubber, polyisoprene rubber or styrene-butadiene rubber. The polybutadiene can be synthesized with a metal catalyst such as a rare-earth catalyst (e.g., a neodymium catalyst), a cobalt catalyst or a nickel catalyst.

The base rubber may have mixed therein other components, including a co-crosslinking agent, examples of which include unsaturated carboxylic acids and their metal salts; an organic filler such as zinc oxide, barium sulfate or calcium carbonate; and an organic peroxide such as dicumyl peroxide or 1,1-bis(t-butylperoxy)cyclohexane. If necessary, other components such as a commercial antioxidant may be suitably added as well.

The solid core may be formed as a single layer or as a two-layer structure having an outer layer. When a core having a two-layer structure is formed, the outer layer may be made of the same type of rubber material as the center core or a different type of rubber material from the center core.

The solid core has a diameter of preferably at least 30.0 mm, more preferably at least 34.0 mm, and even more preferably at least 37.0 mm, but preferably not more than 40.3 mm, more preferably not more than 40.0 mm, and even more preferably not more than 39.8 mm. If the solid core has too small a diameter, the cover will be relatively thick. Also, should the luster pigment be added to the cover material, this may diminish the cover transparency and lower the brightness of the ball. Moreover, a large amount of the expensive pigment will be used, which is undesirable from the standpoint of cost effectiveness. On the other hand, if the solid core has too large a diameter, the cover will be relatively thin, which may lower the durability of the ball to repeated impact.

The hardness of the solid core is described. The solid core has a deflection, when compressed under a final load of 1,275 N (130 kgf) from an initial load state of 98 N (10 kgf), of preferably at least 2.5 mm, more preferably at least 3.0 mm, and even more preferably at least 3.2 mm, but preferably not more than 5.0, more preferably not more than 4.0 mm, and even more preferably not more than 3.6 mm. If the deflection is too small, the feel of the ball on impact may be too hard or the speed at which the ball separates from the face of the club may be so rapid as to compromise the controllability of the ball. On the other hand, too large a deflection may give the ball too soft a feel, reduce the durability of the ball to cracking on repeated impact, and lower the rebound so that a good distance is not achieved.

Next, in the practice of the invention, the cover enclosing the solid core is made of one or more layers. A thermoplastic resin or a thermoplastic elastomer may be preferably used as the cover layer material. Exemplary thermoplastic resins include ionomer resins. Commercial ionomers that may be used include Himilan (produced by DuPont-Mitsui Polychemicals Co., Ltd.), Surlyn (E.I. DuPont de Nemours and Co.) and Iotek (Exxon Corporation). Exemplary thermoplastic elastomers include polyester, polyamide, polyurethane, olefin and styrene elastomers. Commercial thermoplastic elastomers that may be used include Hytrel (DuPont-Toray Co., Ltd.), Perprene (Toyobo Co., Ltd.), Pebax (Toray Industries, Inc.), Pandex (Dainippon Ink & Chemicals, Inc.), Santoprene (Monsanto Chemical Co.), Tuftec (Asahi Kasei Kogyo Co., Ltd.) and Dynaron (JSR Corporation). It is preferable for the thermoplastic resin or thermoplastic elastomer to be an ionomer resin or a thermoplastic polyurethane elastomer.

When a thermoplastic resin is used as the cover material, it is preferable for the thermoplastic resin to have a melt flow index of at least 0.5 g/10 min.

When a thermoset resin is used as the cover material, it is preferable for the thermoset resin to be a thermoset polyurethane resin or a thermoset polyurea resin.

It is desirable for the cover material to have a rebound resilience, measured according to JIS-K 7311, of at least 30%.

The cover has a Shore D hardness of preferably at least 35, more preferably at least 40, and even more preferably at least 45, but preferably not more than 70, more preferably not more than 68, and even more preferably not more than 65. If the Shore D hardness of the cover is harder than the above range, the ball may have a poor durability to repeated impact and too hard a feel on impact. On the other hand, if the cover is too soft, the rebound may decrease and the spin rate may rise, resulting in a shorter distance of travel.

When the above-described cover is used as an outer layer (or outermost layer), it has a thickness of preferably at least 0.7 mm, more preferably at least 0.8 mm, and even more preferably at least 0.9 mm, but preferably not more than 1.9 mm, more preferably not more than 1.85 mm, and even more preferably not more than 1.75 mm. If the cover is thicker than the above range, the rebound of the ball may decrease. On the other hand, if the cover is thinner than the above range, the durability of the ball to repeated impact may worsen.

When the cover has two layers, to obtain various types of balls, it is desirable for the inner cover layer to be made of a different material and to have a different Shore D hardness than the outer cover layer.

Numerous dimples may be formed on the surface of the cover. To achieve a good distance, the number of dimples is preferably at least 200, more preferably at least 250, and even more preferably at least 300, but preferably not more than 500, more preferably not more than 450, and even more preferably not more than 440.

Next, in the present invention, a paint film is formed on the surface of the cover. The paint applied onto the cover surface is not subject to any particular limitation. However, because it is necessary for the golf ball surface to be able to withstand a large deformation when directly struck with a golf club, the use of a two-part curing urethane paint is preferred. The two-part curing urethane paint is composed of a polyol component having hydroxyl groups and a polyisocyanate component having isocyanate groups.

A white color is generally preferred in golf balls. Accordingly, it is preferable for a non-yellowing isocyanate curing agent to be used in the two-part curing urethane paint. However, to improve adhesion and other properties, concomitant use may be made of a yellowing or yellowing-resistant isocyanate to a degree that does not compromise the weather resistance. Examples of polyols that may be used include primarily urethanes, polyesters and acrylic resins, although other resins, including epoxy resins, may be used if necessary. Examples of polyisocyanates that may be used include tolylene diisocyanate (TDI), diphenylmethane-4,4'-diisocyanate (MDI), hexamethylene diisocyanate (HDI), isophorone diisocyanate (IPDI), naphthalene diisocyanate (NDI), 1,4-phenylene diisocyanate (PDI), xylylene diisocyanate (XDI) and hydrogenated xylylene diisocyanate (HXDI), either singly or in modified forms as combinations thereof. The polyisocyanate component may generally take the form of an adduct, a biuret or an isocyanurate.

The paint used in the invention is composed of the above-described resin as the base, to which any of various solvents and additives may be suitably added.

In the present invention, use is made of a luster pigment, which pigment is included in the cover material and/or the paint film. When the cover is formed of two or more layers, it is preferable to include the luster pigment in the cover material for the outer cover layer rather than the inner cover layer. When the luster pigment is included in the cover material, the amount of the luster pigment per 100 parts by weight of the resin or elastomer making up the cover material is preferably at least 0.1 part by weight, more preferably at least 0.2 part by weight, and even more preferably at least 0.3 part by weight, but preferably not more than 10 parts by weight, more preferably not more than 5 parts by weight, and even more preferably not more than 2 parts by weight.

The luster pigment used in the invention is included within the paint film in an amount, per 100 parts by weight of base resin (solids) in the paint, of preferably at least 1 part by weight, and more preferably at least 2 parts by weight, but preferably not more than 15 parts by weight, and more preferably not more than 10 parts by weight. If the amount of the luster pigment added is smaller than the above range, the ball may lack sufficient brightness and the objects of the invention may not be achieved. On the other hand, if too much luster pigment is added, the physical properties of the paint film may decline, making it impossible to maintain a good durability.

The film thickness obtained by applying the above paint, while not subject to any particular limitation, is preferably at least 2 μm, more preferably at least 3 μm, and even more preferably at least 4 μm, but preferably not more than 50μ, more preferably not more than 40μ, and even more preferably not more than 30 μm.

A material composed of metal oxide-coated alumina flakes is used as the luster pigment. The type of metal oxide used to coat the alumina is preferably at least one selected from the group consisting of titanium oxide, iron oxide and zinc oxide. Of these, the use of titanium oxide ($TiO_2$) and iron oxide ($Fe_2O_3$) is preferable because they impart a bright, color-saturated effect. Examples of aluminum oxide flakes coated with titanium oxide that may be used as the luster pigment include the commercial products available under the following trade names: Xirallic T60-10 WNT Crystal Silver, Xirallic T60-20 WNT Sunbeam Gold, Xirallic T60-21 WNT Solaris Red, Xirallic T60-22 WNT Amethyst Dream, Xirallic T60-23 WNT Galaxy Blue, Xirallic T60-24 WNT Stellar Green and Xirallic T60-25 WNT Cosmic Turquoise (all products of Merck Ltd., Japan). Examples of aluminum oxide flakes coated with iron oxide that may be used as the luster pigment include the commercial products available under the following trade names: Xirallic T60-50 WNT Fireside Copper and Xirallic T60-51 WNT Radiant Red (both products of Merck Ltd., Japan). These luster pigments have a particle size such that, at an average particle size of 18 μm, the lower limit in the particle size distribution is preferably at least 1 μm, more preferably at least 2 μm, and even more preferably at least 5 μm; and the upper limit is preferably not more than 50 μm, more preferably not more than 40 μm, and even more preferably not more than 30 μm.

When the luster pigment is used in the paint film on the golf ball surface, to ensure the paint has a long shelf life, if is desirable to use an additive for dispersing the pigment and preventing it from settling. Examples of such dispersion and anti-settling additives include organic bentonite, amide wax, oxidized polyamide wax, hydrogenated castor oil wax, metal soaps, oxidized polyethylene, polymerized vegetable oils, sulfate ester-type anionic activators, amine salts of polycarboxylic acids, ultrafine silica, magnesium aluminum silicate, xanthan gum and guar g In a solvent system, use is primarily made of organic bentonite, amide wax, oxidized polyamide wax, hydrogenated castor oil wax, metal soaps, oxidized polyethylene, polymerized vegetable oils, sulfate ester-type anionic activators and amine salts of polycarboxylic acids. In the practice of the invention, taking into account redispersibility after settling, the use of a polyamide system or an oxidized polyamide system is especially preferred.

Moreover, it is desirable to use on the paint supply line a system which mixes the paint constantly or at fixed intervals. A specific example of a preferred method for accomplishing this is a method which uses a circulating spray gun.

The above dispersion and anti-settling additive is added to the paint in an amount, per 100 parts by weight of the formulated paint (i.e., the paint which already includes a polyol component, an isocyanate component and necessary additives), of preferably at least 0.05 part by weight, and more preferably at least 0.1 part by weight, but preferably not more than 10 parts by weight, and more preferably not more than 5 parts by weight. If the dispersion and anti-settling additive is added in an amount lower than the above range, the pigment concentration will vary due to more rapid settling of the pigment, making it impossible to achieve a stable appearance. Moreover, because pigment that has settled during storage does not easily redisperse, considerable effort is required for redispersion. Conversely, if too much dispersion and anti-settling additive is added to the paint, this additive may rise to the surface of the paint film, making the film tacky, or it may negatively affect the physical properties of the paint film, preventing the paint film from functioning as a material that protects the appearance of the golf ball. Moreover, the initial viscosity becomes higher, resulting in a large change in paint viscosity following formulation, and thus a loss of stability during painting.

It is desirable for the appearance of the inventive golf ball to be such that the ball has a bright, color-saturated effect and, when seen from a distance, emits light of a desired color from its surface.

The golf ball of the invention, so long as it is a ball having a solid core of at least one layer which is enclosed with one or more cover layer, may be in any of various forms, including solid two-piece golf balls and solid multi-piece golf balls which are composed of three or more pieces and include on the outside a cover formed of two or more layers. The golf ball of the invention can be made in accordance with the Rules of Golf for use in competitive play, in which case the ball may be formed to a diameter of not less than 42.67 mm and a weight of not more than 45.93 g. It is recommended that the upper limit for the diameter be preferably not more than 44.0 mm, more preferably not more than 43.5 mm, and even more preferably not more than 43.0 mm, and that the lower limit for the weight be preferably not less than 44.5 g, more preferably not less than 45.0 g, even more preferably not less than 45.1 g, and most preferably not less than 45.2 g.

As explained above, the golf ball of the invention has a striking visual impact and a high quality feel. Because it achieves a bright, color-saturated effect without the yellow cast typically seen on the surface of conventional balls made using mica-based luster pigments, the inventive ball has a high commercial value.

EXAMPLES

Examples of the invention and Comparative Examples are given below by way of illustration and not by way of limitation.

Synthesis of Hydroxyl Group-Bearing Polyester

Composition:

| | |
|---|---|
| Adipic acid | 1,080 parts by weight |
| Trimethylolpropane | 716 parts by weight |
| Neopentyl glycol | 240 parts by weight |
| 1,4-Dicyclohexanedimethanol | 165 parts by weight |

The above ingredients were mixed, then heated at 200 to 240° C. for 5 hours, giving a polyester having an acid value of 6, a hydroxyl value of 240 and a weight-average molecular weight of 15,000.

The polyester prepared above was dissolved in a solvent mixture of butyl acetate and propylene glycol monomethyl ether acetate (PMA) so as to prepare the following varnish containing 70 wt % nonvolatiles and having a hydroxyl value of 168.

Varnish Preparation

Composition:

| | |
|---|---|
| Polyester resin (acid value, 6; hydroxyl value, 240) | 70 parts by weight |
| Butyl acetate | 15 parts by weight |
| Propylene glycol monomethyl ether acetate (PMA) | 15 parts by weight |

Paint Formulation

The above varnish and an isocyanate curing agent were combined to produce the base paints shown below (liquids A and B). The luster pigment and other additives were added to this base paint so as to produce the paints in Examples 1 to 11 of the invention. To check the pigment stability and redispersibility in these paints, the base paint was left to stand one full day, following which the pigment that had settled was redispersed and mixture with the curing agent was carried out.

While being stirred at fixed intervals, the formulated paint was applied with an air spray gun to the surface of spheres composed of a single-layer core and a single-layer cover, thereby producing golf balls having a paint film with a thickness of 18 μm.

The characteristics shown below were evaluated to assess the ball performance.

TABLE 1

| Base paint formulation (parts by weight) | Liquid A | Liquid B |
|---|---|---|
| Varnish (hydroxyl group-bearing polyester: 70% solids; OH value, 168) | 82 | 0 |
| Butyl acetate | 118 | 34.5 |
| Non-yellowing polyisocyanate (trade name: Takenate D170N; solids, 100% solids, 20.7% NCO) | 0 | 21.5 |
| Yellowing polyisocyanate (trade name: Takenate D204; 50% solids, 7.5% NCO) | 0 | 44 |
| Curing catalyst (dibutyltin dilaurate) | 0.005 | 0.005 |

Note:

Takenate is a trade name of Mitsui Chemical Polyurethanes, Inc.

Trade names for the above ingredients are as follows.

Oxidized polyamide wax: Trade name, Disparon PFA230 (20% solids); produced by Kusumoto Chemicals, Ltd.

Oxidized polyethylene: Trade name, Disparon PF910; produced by Kusumoto Chemicals, Ltd.

Luster Pigment (1): Xirallic T60-10 WNT Crystal Sliver; produced by Merck Ltd., Japan.

Particle size distribution, 5 to 30 μm.

Luster Pigment (2): Xirallic T60-23 WNT Galaxy Blue; Produced by Merck Ltd., Japan.

Particle size distribution, 5 to 30 μm.

Redispersibility

After one full day of standing, the paint was lightly shaken to re-agitate the pigment, following which the bottom of the container was scraped with a spatula to check for the presence of settled pigment.

Exc: No settled pigment observed.

Good: Very small amount of settled pigment found on spatula tip.

Fair: Substantial amount of settled pigment found on spatula.

NG: Settled pigment had thickened.

Appearance

The appearance of the painted golf ball was visually rated in the presence of sunlight.

Exc: Intensely bright.

Good: Bright.

Fair: Somewhat bright.

NG: Weak or substantially no brightness.

Viscosity

After the paint was formulated, the pot life was determined by measuring the period until the dropping time (the time it takes for a fixed amount of flowing paint to fall) exceeds 2 seconds as measured using an Iwata cup NK-2 from the initial viscosity on formulation. This pot life was used as an indicator of the ease of use.

Exc: At least 3 hours (very easy to use).

Good: At least 2 hours (easy to use).

Fair: At least 1 hour (somewhat difficult to use).

NG: Less than 1 hour (difficult to use).

TABLE 2

| Example | | 1 | 2 | 3 | 4 | 5 | 6 | 7 | 8 | 9 | 10 | 11 |
|---|---|---|---|---|---|---|---|---|---|---|---|---|
| Paint formulation | Liquid A | 100 | 100 | 100 | 100 | 100 | 100 | 100 | 100 | 100 | 100 | 100 |
| | Liquid B | 50 | 50 | 50 | 50 | 50 | 50 | 50 | 50 | 50 | 50 | 50 |
| | Oxidized polyamide wax | 0.25 | 0.5 | 1 | 2.5 | 5 | 1 | 1 | 1 | 1 | 1 | 1 |
| | Oxidized polyethylene | 0 | 0 | 0 | 0 | 0 | 0 | 0 | 0 | 0 | 0 | 0 |
| | Effect pigment (1) | 1.5 | 1.5 | 1.5 | 1.5 | 1.5 | 0.5 | 1 | 3 | 5 | 7.5 | |
| | Effect pigment (2) | | | | | | | | | | | 1.5 |
| Redispersibility | | good | good | Exc | Exc | Exc | Exc | Exc | Exc | Exc | Exc | Exc |
| Performance | Appearance | good | good | good | good | good | fair | good | good | Exc | Exc | good |
| | Viscosity | good | good | good | fair | fair | Exc | good | good | fair | fair | good |
| | Dryability | good | good | good | fair | fair | good | good | good | good | good | good |
| | Abrasion test | good | good | good | good | fair | good | good | good | good | fair | good |
| | Weather resistance | good | good | Exc | Exc | Exc | Exc | Exc | Exc | Exc | Exc | Exc |

Note:

Numbers in "Paint formulation" section indicate parts by weight of ingredient included per 100 parts by weight of liquid A.

Dryability

After 1 hour of drying at 55° C., the surface of the ball was checked for tackiness by the finger touch technique.

Exc: No tack.

Good: Slight tack remaining

Fair: Tacky.

NG: Not dry (fingerprint remains in paint film).

Abrasion Test

A painted golf ball and 1.5 liters of abrasive (available from Showa Denko K.K. under the trade name Morundum; size, 58) were placed in a magnetic ball mill of 8 liter capacity, and mixing was carried out for 2 hours. Ratings were based on a visual assessment of the decrease in gloss and the extent of peeling at the surface of the golf ball.

Exc: No peeling; surface is glossy.

Good: No peeling; slight decrease in gloss.

Fair: Slight peeling observable.

NG: Significant peeling.

Weather Resistance

A golf ball was subjected to accelerated discoloration by being held for 24 hours at a distance of 350 mm from a 6 kW metal halide lamp as the light source, following which the color difference (ΔE) before and after exposure was measured. The color difference meter used for measurement was a multiple light source spectrocolorimeter, model SC-P (conditions: C light, 2° field, open-path (excluding specularly reflected light) Hunter colorimeter), manufactured by Suga Test Instruments Co., Ltd.

Exc: $\Delta E<3$

Good: $3\leq\Delta E\leq5$

Fair: $5\leq\Delta E\leq10$

NG: $10\leq\Delta E$

The invention claimed is:

1. A golf ball comprising a solid core of at least one layer, a cover of at least one cover layer encasing the core, and a paint layer on a surface of the cover, wherein the golf ball is presumed to be white and the paint layer includes a luster pigment consisting of metal oxide-coated alumina flakes, provided that the paint layer does not include any other luster pigment.

2. The golf ball of claim 1, wherein the cover is formed of two or more layers, one of which is an outer cover layer that includes therein the luster pigment.

3. The golf ball of claim 1, wherein the metal oxide in the luster pigment is of at least one type selected from the group consisting of titanium oxide, iron oxide and zinc oxide.

4. The golf ball of claim 1, wherein the luster pigment has a particle size distribution of from 1 to 50 μm.

5. The golf ball of claim 1, wherein the paint layer on the surface of the cover is formed of a paint composed of a thermoset polyurethane.

6. The golf ball of claim 1, wherein a luster pigment dispersion and anti-setting additive are added to the luster pigment.

7. The golf ball of claim 1, wherein the paint layer is formed of a paint which includes the luster pigment in an amount of from 1 to 15 parts by weight per 100 parts by weight of base resin (solids) in the paint.

8. The golf ball of claim 6, wherein the luster pigment dispersion and anti-settling additive is at least one selected from the group consisting of amide system wax, oxidized polyamide system wax, and oxidized polyethylene.

9. The golf ball of claim 8, wherein the luster pigment dispersion and anti-settling additive is included in an amount of from 0.05 to 5 parts by weight per 100 parts by weight of paint which already includes a polyol component, an isocyanate component and necessary additives.

10. The golf ball of claim 1, wherein the cover is formed of at least one selected from the group consisting of thermoplastic resins, thermoplastic elastomers, and thermoset resins.

11. The golf ball of claim 10, wherein the cover includes the luster pigment in an amount of from 0.1 to 10 parts by weight per 100 parts by weight of the resin and/or elastomer making up the cover.

12. The golf ball of claim 1, wherein both of the at least one cover layer and the paint layer include a luster pigment composed of metal oxide-coated alumina flakes.

13. The golf ball of claim 1, wherein the solid core has a deflection, when compressed under a final load of 1,275 N (130 kgf) from an initial load state of 98 N (10 kgf), of at least 2.5 mm but not more than 3.6 mm.

14. The golf ball of claim 1, wherein the cover material is a thermoplastic resin that has a melt flow index of at least 0.5 g/10 min.

15. The golf ball of claim 1, wherein the cover material has a rebound resilience, measured according to JIS-K 7311, of at least 30%.

* * * * *